United States Patent [19]

Junkers

[11] Patent Number: 4,846,028

[45] Date of Patent: Jul. 11, 1989

[54] FLUID-OPERATED WRENCH

[76] Inventor: John K. Junkers, 7 Arrowhead La., Saddle River, N.J. 07458

[21] Appl. No.: 107,581

[22] Filed: Oct. 6, 1987

[51] Int. Cl.[4] ..... B25B 13/46

[52] U.S. Cl. ..... 81/57.39; 81/55

[58] Field of Search ..... 81/57.39, 55, 56

[56] References Cited

U.S. PATENT DOCUMENTS

| | | | |
|---|---|---|---|
| 2,760,394 | 8/1956 | Wragge | 81/55 |
| 2,885,919 | 5/1959 | Carlson | 81/56 |
| 3,759,119 | 9/1973 | Wing | 81/57.39 |
| 3,791,242 | 2/1974 | Bartusch | 81/57.39 X |
| 3,916,734 | 11/1975 | Sawan | 81/56 |
| 4,309,923 | 1/1982 | Wilmeth | 81/57.39 X |
| 4,671,142 | 6/1987 | Junkes | 81/57.39 |

*Primary Examiner*—Debra Meislin

*Attorney, Agent, or Firm*—Michael J. Striker

[57] ABSTRACT

A fluid-operated wrench for tightening and loosening of threaded connectors, comprises a housing, drive unit arranged substantially in the housing, and engaging unit arranged to engage a threaded connector for tightening or loosening the same, the engaging unit being operatively connected with the drive unit so as to be turned and thereby to turn a threaded connector, the housing having a portion which extends to the engaging unit and forms an axle on which the engaging unit turns.

2 Claims, 2 Drawing Sheets

FLUID-OPERATED WRENCH

BACKGROUND OF THE INVENTION

The present invention relates to a fluid-operated wrench for tightening and loosening of threaded connectors, such as bolts, nuts and the like.

Fluid-operated wrenches are widely known in the art. A known fluid-operated wrench includes a housing, drive means, and engaging means which is engageable with a threaded connector and turnable by the drive means for turning the threaded connector so as to tighten or loosen the latter. In existing fluid-operated wrenches, the engaging means is turnable by a transmission element arranged between the drive means and the engaging means. The housing itself does not directly support the engaging means. There are many instances in which a threaded connector, for example, a bolt, must not be subjected to usual reaction forces to prevent its bending. This is especially important when the bolt is very long and can break under the action of such reaction forces. The fact that in the known fluid-operated wrenches the engaging means is not directly supported by the housing does not eliminate the above-described problem of applying reaction forces to a long threaded connector, for example a bolt, so as to avoid bending of the latter. Therefore, the object of the invention is to eliminate the disadvantages of the prior art.

SUMMARY OF THE INVENTION

In keeping with these objects and with others which will become apparent hereinafter, one feature of the present invention resides, briefly stated, in a fluid-operated wrench for tightening or loosening a threaded connector, which comprises a housing, drive means arranged substantially in the housing, and engaging means arranged to engage a threaded connector for tightening or loosening the same, the engaging means being operatively connected with the drive means so as to be turned and thereby to turn a threaded connector, the housing having a portion which extends to the engaging means and forms an axle on which the engaging means turns.

When the fluid-operated wrench is designed in accordance with the present invention, a center axis of the engaging means is defined by an axle which is a portion of the housing, so that the engaging means turns on the portion of the housing. While the engaging means engages with the nut portion of a threaded connector, the axle engages with the bolt portion of said threaded connector. The reaction force is therefore not transferred to a threaded connector adjacent to the one to be tightened or loosened but directly on to the bolt portion of the threaded connector to be tightened or loosened. The usual bending force is thus eliminated. The reaction force is not transferred to a threaded connector adjacent to the one to be tightened or loosened so that neither one of the threaded connectors is subjected to a bending force. The tool also eliminates torsional buildup in the bolt or the stud which has always been a problem with prior art.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
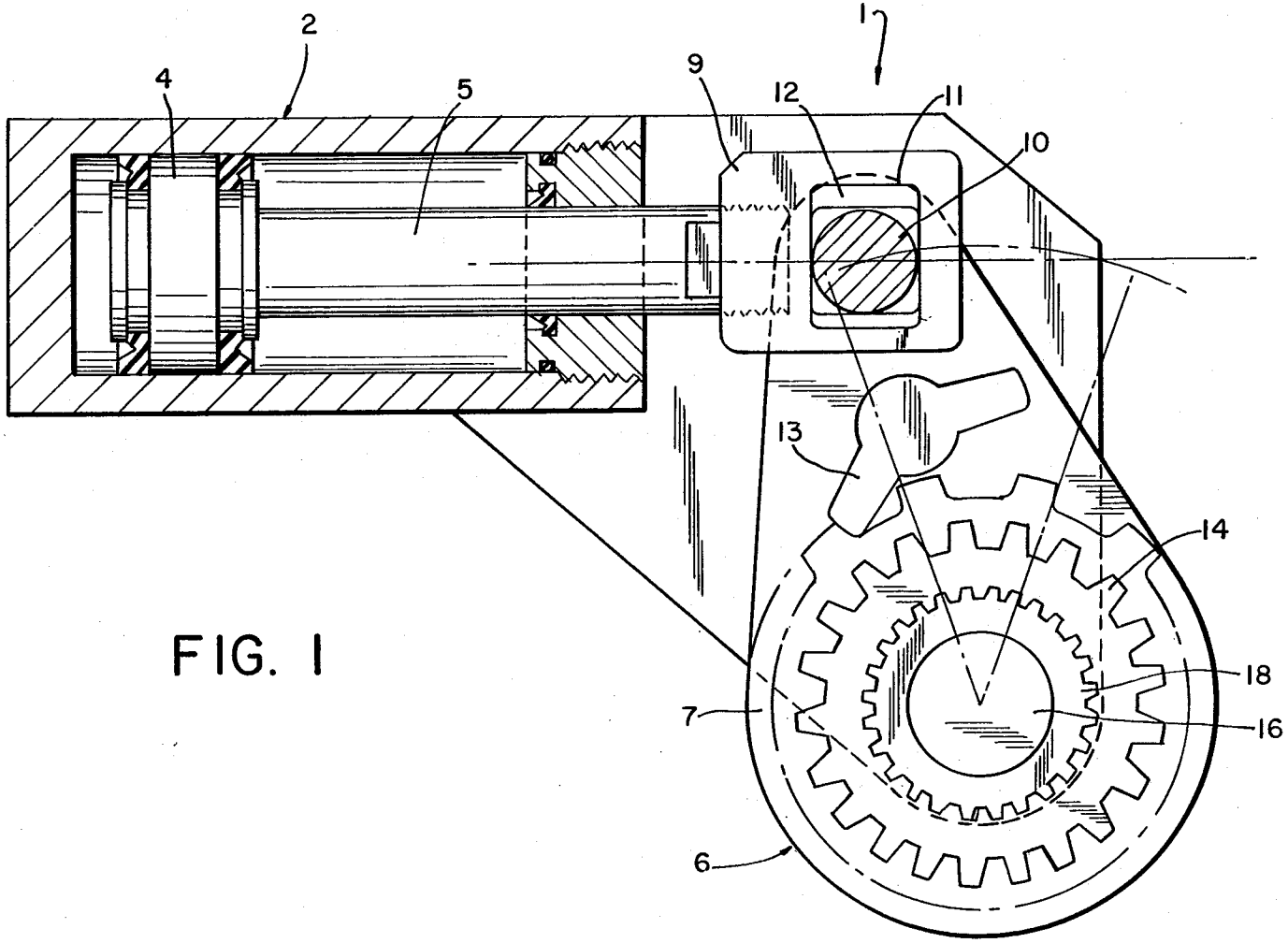
FIG. 1 is a side view of a fluid-operated wrench in accordance with the present invention.
Figure 2:
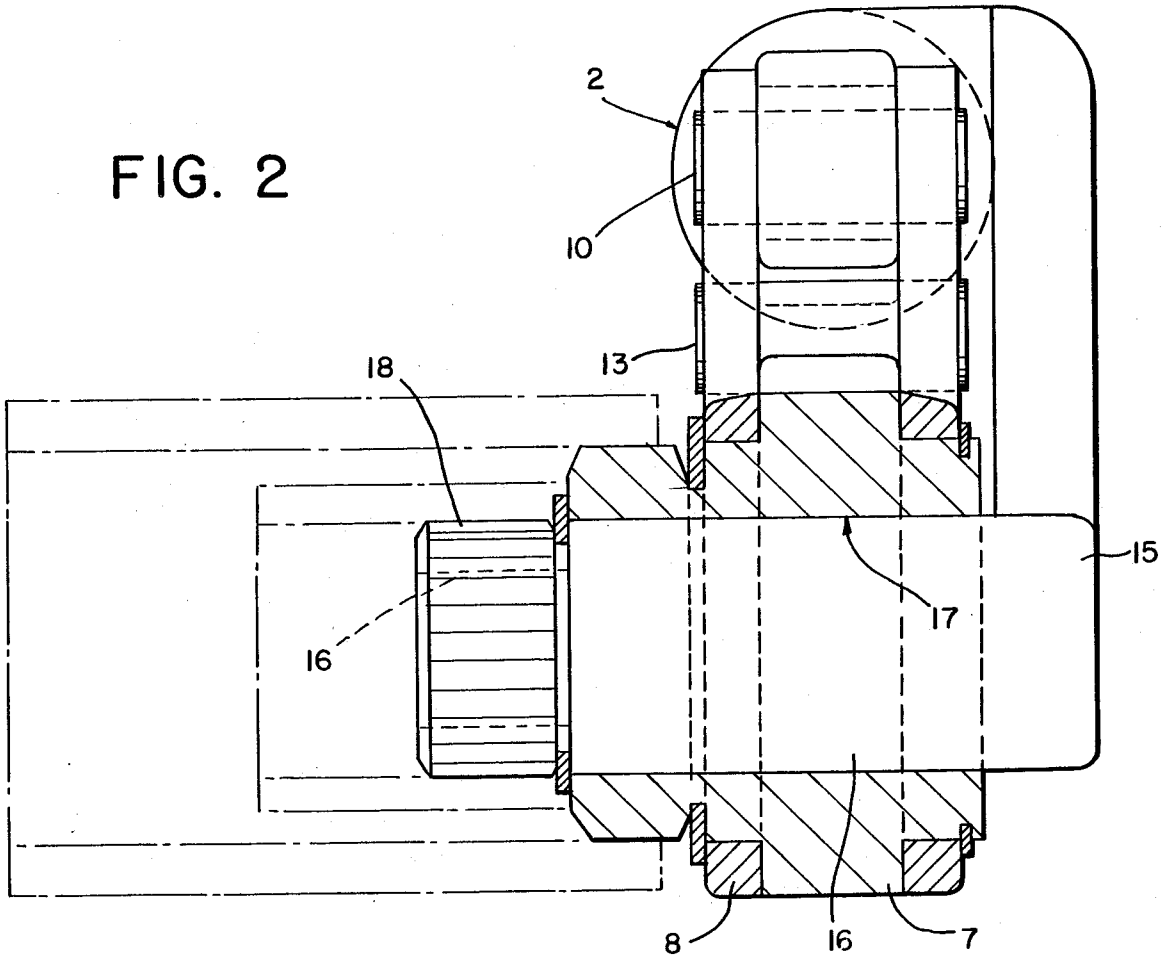
FIG. 2 is a front and partially sectioned view of the inventive fluid-operated wrench of FIG. 1.

A fluid-operated wrench in accordance with the present invention has a housing which is identified as a whole with reference numeral 1. The housing has a drive supporting housing portion 2 which supports a drive including a cylinder 3 and a piston 4 which is movable in the cylinder 3 and has a piston rod 5 extending axially beyond the cylinder. The cylinderpistion unit 4, 5 is fluid-operated, such that the piston reciprocates in the cylinder under the action of a fluid admitted at the respective side of the piston through not shown passages.

An engaging unit for engaging a threaded connector to be tightened or loosened is identified as a whole with reference numeral 6. It has a ratchet 7 provided with a plurality of outer teeth. A transmission unit converts the reciprocating movement of the piston rod 5 into a turning movement of the ratchet 7. The transmission unit includes two plates 8 each having an upper end turnably connected with an end piece 9 of the piston rod 5 by means of a pin 10 which in turn is arranged in a rectangular member 11 slidable up and down in a rectangular opening 12 of the end piece 9. The transmission unit also includes a by-directional drive pawl 13 which is attached to the plates 8 and has two opposite teeth engageable with the outer teeth of the ratchet 7, depending on the direction of turning of the plates 8.

The engaging unit also has a formation 14 to which an engaging member can be attached, such as for example a socket which engages a nut to be turned. The formation 14 can be formed as a spline, a square, or a hexagon. On the other hand, the formation 14 can be formed so that it directly engages a nut to be turned without attaching any additional member thereto.

The housing 1 has an intermediate housing portion 15 which extends from the drive-supporting housing portion 2 and connects the latter with an axle-forming housing portion 16. The axle-forming housing portion 16 is formed as an axle which extends through an inner opening 17 of the ratchet 7 and turnably supports the ratchet. The axle-forming housing portion 16 has a free end which extends axially outwardly beyond the ratchet 7 and is provided with a formation 18. The formation 18 can be formed as a spline, a square, or a hexagon to which a socket could be attached for engaging with a bolt. It is to be understood that the formation 18 can be formed itself for engaging the bolt.

It is to be understood that the housing portions 2, 15, 16 can be formed of one piece with one another, as a single piece integral member. On the other hand, they can be formed as separate member; which are fixedly connected with one another, for example by welding, etc.

The fluid-operated wrench in accordance with the invention operates in the following manner. When it is necessary for example to turn a nut which is arranged on a bolt, a socket attached to the formation 18 of the axle-forming housing portion 16 is fitted onto a head of the bolt, while another socket which is attached to the formation 14 of the ratchet 7 is fitted onto the nut. When the drive is actuated and the piston rod 5 moves axially relative to the cylinder 3, the plates 8 turn about an axis of the axle-forming housing portion 16 and the pawl 13 turns the ratchet 7. While the bolt is firmly held by the socket attached to the formation 18, the nut is turned by the other socket which is attached to the formation 14 of the ratchet 7 and turns together with the latter.

It will be understood that each of the elements described above, or two or more together, may also find a useful application in other types of constructions differing from the types described above.

While the invention has been illustrated and described as embodied in a fluid-operated wrench for tightening or loosening a threaded connector, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A fluid-operated wrench for tightening or loosening of threaded connectors, comprising a housing having a drive supporting portion extending in a first direction, an intermediate portion extending from said drive supporting portion in a second direction which is substantially perpendicular to said first direction, and an end portion extending from said intermediate portion in a third direction substantially perpendicular to said first and second directions; drive means accommodated substantially in said housing and including a fluid-operated cylinder-piston unit with a cylinder extending in said first direction and a piston movable in said cylinder in said first direction, said cylinder-piston being supported by said drive supporting portion of said housing; and engaging means arranged to engage one part of a threaded connector for tightening or loosening the same; a ratchet wheel attached to said engaging means, a transmission means attached at one end thereof to said piston and rotatably supported by a portion of said ratchet wheel at the opposite end, a pawl means attached to said transmission means for engagement with said ratchet wheel to enable a ratcheting action of said wrench; said end portion of said housing extending through said engaging means and extending through said ratchet wheel, so as to form an axle on which said ratchet wheel turns, said end portion of said housing also having means for supporting a holding element which holds another part of the threaded connector during turning the one part of the threaded connector by said ratchet.

2. A fluid-operated wrench as defined in claim 11 wherein said housing is a one piece element.

* * * * *